US008187349B2

(12) United States Patent
Jancker et al.

(10) Patent No.: US 8,187,349 B2
(45) Date of Patent: May 29, 2012

(54) GASIFICATION REACTOR VESSEL

(75) Inventors: Steffen Jancker, Gummerbach (DE); Thomas Paul Von Kossak-Glowczewski, Gummersbach (DE); Joachim Wolff, Amsterdam (NL)

(73) Assignee: Shell Oil Company, Houston, TX (US)

( * ) Notice: Subject to any disclaimer, the term of this patent is extended or adjusted under 35 U.S.C. 154(b) by 621 days.

(21) Appl. No.: 12/048,525

(22) Filed: Mar. 14, 2008

(65) Prior Publication Data

US 2008/0222955 A1 Sep. 18, 2008

Related U.S. Application Data

(60) Provisional application No. 60/895,908, filed on Mar. 20, 2007.

(30) Foreign Application Priority Data

Mar. 15, 2007 (EP) ..... 07104222

(51) Int. Cl.
*C10J 3/68* (2006.01)
*B01J 7/00* (2006.01)
*B01J 8/00* (2006.01)

(52) U.S. Cl. ..... 48/76; 48/67; 48/127.9; 48/61; 48/62; 48/63; 48/64; 48/69; 48/77; 165/119; 165/157; 122/7 R

(58) Field of Classification Search ..... 48/76–77, 48/67, 62–64, 69, 127.9
See application file for complete search history.

(56) References Cited

U.S. PATENT DOCUMENTS

| | | | | |
|---|---|---|---|---|
| 2,572,051 | A | 10/1951 | Parry | 48/203 |
| 4,202,672 | A | 5/1980 | Schuurman | 48/77 |
| 4,731,097 | A | 3/1988 | Köhnen et al. | 48/76 |
| 4,818,252 | A | 4/1989 | Köhnen et al. | 48/67 |
| 5,248,316 | A * | 9/1993 | Peise et al. | 48/76 |
| 6,311,629 | B1 * | 11/2001 | Marschner et al. | 110/341 |
| 6,312,482 | B1 | 11/2001 | James et al. | 48/73 |
| 6,562,102 | B1 * | 5/2003 | Kepplinger et al. | 75/445 |
| 7,587,995 | B2 * | 9/2009 | Kraft et al. | 122/7 R |
| 2001/0020346 | A1 | 9/2001 | Schingnitz et al. | 48/127.9 |
| 2008/0222955 | A1 | 9/2008 | Jancker et al. | 48/67 |

FOREIGN PATENT DOCUMENTS

| | | |
|---|---|---|
| CN | 86103455 | * 11/1986 |
| DE | 2425962 | 12/1975 |
| DE | 19643258 | 4/1998 |

* cited by examiner

*Primary Examiner* — Kaity V. Handal

(57) ABSTRACT

A gasification reactor vessel comprising a combustion chamber in the upper half of the vessel, provided with a product gas outlet at the bottom end of the combustion chamber, at least two burner openings are present in the wall of the combustion chamber, which burner openings are located at the same horizontal level and are positioned diametrical relative to each other and wherein in each burner opening a burner is present, wherein between the wall of the combustion chamber and the wall of vessel an annular space is provided, wherein the wall of the combustion chamber comprises an arrangement of interconnected tubes (vertical arranged or helical coiled), wherein the product gas outlet at the bottom end of the combustion chamber is fluidly connected to a dip-tube, which partly is submerged in a water bath located at the lower end of the reactor vessel, and wherein at the upper end of the dip-tube means are present to add a quenching medium to the, in use, downwardly flowing mixture of hydrogen and carbon monoxide.

6 Claims, 4 Drawing Sheets

GASIFICATION REACTOR VESSEL

This application claims the benefit of European Application 07104222.0 filed Mar. 15, 2007 and U.S. Provisional Application No. 60/895,908 filed Mar. 20, 2007, the entire disclosures of which are hereby incorporated by reference.

FIELD OF THE INVENTION

The invention is directed to an improved gasification reactor vessel, comprising a combustion chamber in the upper half of the vessel, provided with a product gas outlet at the bottom end of the combustion chamber, a burner positioned such that, in use, it fires into the combustion chamber.

BACKGROUND OF THE INVENTION

In the field of entrained flow gasification two types of gasification reactors have been developed, namely the types as described in for example U.S. Pat. No. 4,202,672, U.S. Pat. No. 6,312,482 and DE-A-2425962, and types as for example described in U.S. Pat. No. 5,968,212 and US-A-2001/0020346. Both reactor type have a combustion chamber into which a burner discharges a product gas comprising hydrogen and carbon monoxide. The gasification reactors of the first type have a product gas outlet at the upper end of the, in use, combustion chamber and an opening for discharge of slag, at the opposite, lower end of the combustion chamber. The second type of reactor has a combined outlet for both product gas and slag at the, in use, lower end of the combustion chamber. The invention is directed to an improved gasification reactor of the second type.

U.S. Pat. No. 5,968,212 describes a gasification reactor provided at its upper end with a downwardly directed burner. The reactor is also provided with a combustion chamber. The wall of the combustion chamber is made up of a refractory grade lining. The product gas leaving the opening in the lower end of the combustion chamber may enter a lower part of the reactor which part is provided with a waste heat boiler.

US-A-2001/0020346 discloses a gasification reactor provided at its upper end with a downwardly directed burner. The reactor is also provided with a combustion chamber. The wall of the combustion chamber comprises an arrangement of vertical and parallel-arranged tubes placed on the interior of the reactor wall. According to this publication, a protective layer of slag will form on the wall of the combustion chamber when an ash-containing feed is used as feed for the gasification reactor. The caked layer of slag will be responsible for the thermal insulation between the combustion chamber and the tubes. According to this publication, such a slag layer will not be formed if a low-ash feed is used. In such a situation, according to US-A-2001/0020346, a lining of refractory brickwork is to be used.

A disadvantage of having to use a refractory brickwork when feeding to said gasification reactor a low-ash feed is that the lifetime of the refractory brickwork is low. It appears that the operational temperature window of a refractory layer of this type is very limited. Temporarily high gas temperatures, as can be the case in an upset situation, will damage and dissolve the refractory. This could happen even if the ash content in the feed is very low.

The object of the present invention is to provide a gasification reactor, which can run on any feed for a prolonged period of time, even if the ash content is very low.

SUMMARY OF THE INVENTION

This object is achieved by the following gasification reactor. Gasification reactor vessel, comprising a combustion chamber in the upper half of the vessel, when in use, provided with a product gas outlet at the bottom end of the combustion chamber, a burner positioned such that, in use, it fires into the combustion chamber, said burner provided with at least supply conduits for an oxidiser gas and a carbonaceous feed, wherein between the wall of the combustion chamber and the wall of vessel an annular space is provided, and wherein the wall of the combustion chamber comprises an arrangement of interconnected tubes, and wherein two burner openings are present in the wall of the combustion chamber, which burner openings are located at the same horizontal level and are positioned diametrical relative to each other and wherein in the burner openings a burner is present.

Applicants have found that by directing the burners through the wall of the combustion chamber a spirally formed gas flow results in the combustion chamber which forces the slag to the wall. In such a reactor, it is thus possible to run on a low ash feed while still being able to form an insulating layer of slag. This in turn makes it possible to avoid the use of refractory brickwork. Such a reactor can thus run for a prolonged period of time. A further advantage of this reactor is that the capacity can be greater than the prior art reactors, which only have one burner. Further advantages will become clear when the reactor and its preferred embodiments are described in more detail.

DETAILED DESCRIPTION OF THE FIGURES

The invention shall be illustrated using the following Figures.

Figure 1:
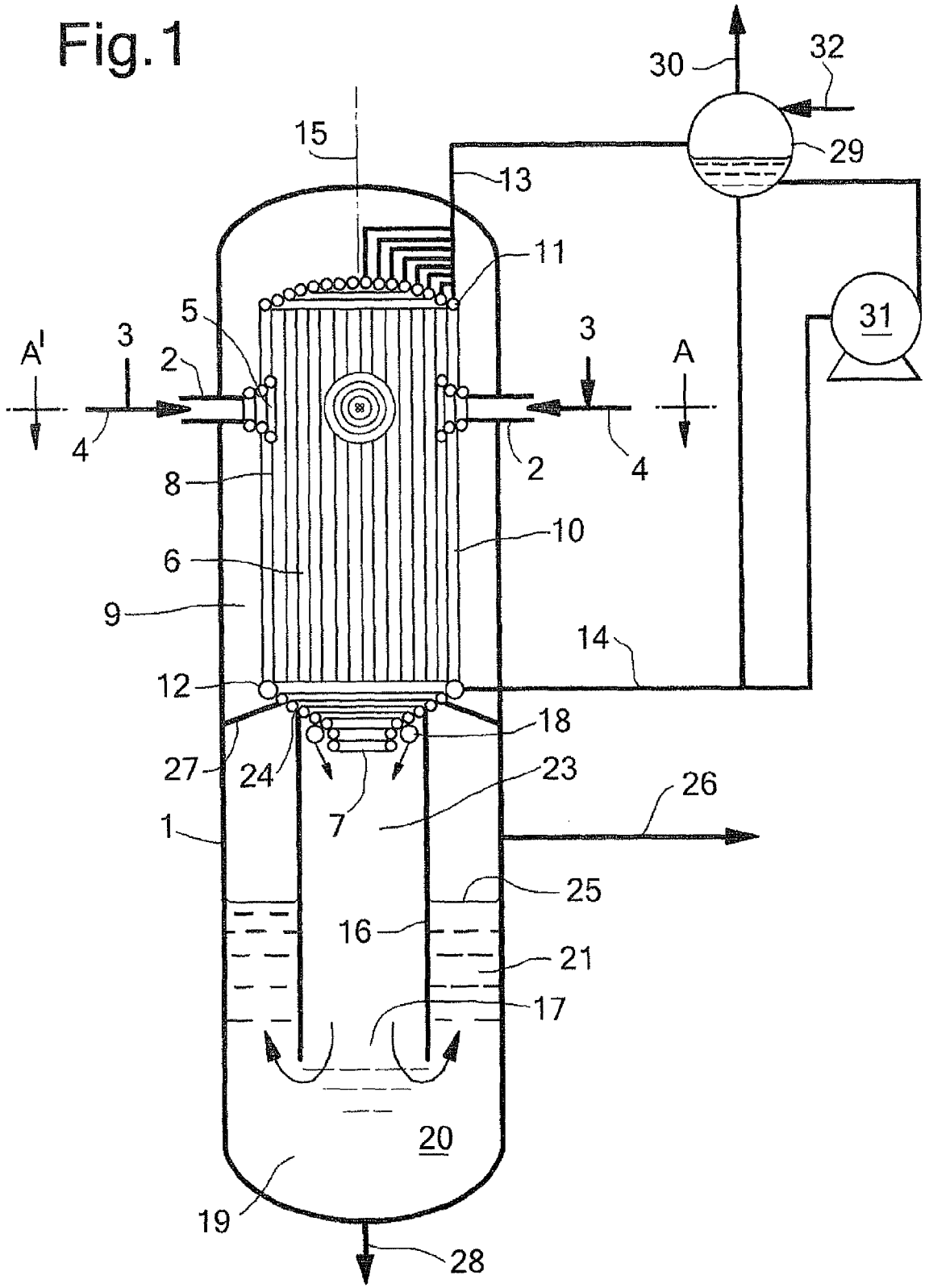
FIG. 1 is a schematic presentation of the reactor according to the present invention and is a cross-sectional view BB' of the reactor of FIG. 2.

FIG. 1 shows a vessel (1), comprising a combustion chamber (6) in the upper half of the vessel (1). Vessel (1) is provided with a product gas outlet (7) at the bottom end of the combustion chamber (6) and two pairs of diametrical positioned burners (2). When in use the vessel (1) is vertically oriented. The words upper, lower, top, bottom, vertical and horizontal relate to the illustrated orientation of the vessel (1). The combustion chamber (6) as shown in FIG. 1 thus has, in use, only one gas outlet (7) at the bottom end. Through this outlet (7) all of the product gas and all of the slag formed, apart from a permanent layer of slag on the interior of wall (8) of the combustion chamber, is discharged from this combustion chamber. Each burner (2) is provided with supply conduits for an oxidiser gas (3) and a carbonaceous feed (4). Optionally a moderator gas and a so-called fluxant, for lowering the slag melting point and decreasing the slag layer thickness, may also be supplied to burner (2). In FIG. 1 a reactor vessel (1) with four burners (2) is illustrated. Preferably four or six burner openings are present at the same horizontal level in the wall of the combustion chamber (6), which openings are evenly distributed along the circumferential of the tubular wall of the combustion chamber. In this manner pairs of diametrical positioned burners are achieved. Alternatively the pairs of burners (2) may be located at different horizontal planes. The pairs of burners may be configured in a staggered configuration relative to a pair at another elevation. In such an embodiment up to and including 8 burners (2) may be present at two or more different horizontal planes.

The burner (2) fire, in use, into the combustion chamber (6) through a burner opening (5) as present in the wall (8) of the combustion chamber (6). The burner openings (5) for each pair of diametrically positioned burners (2) are located at the same horizontal level and are positioned diametrical relative to each other. The burner opening (5) in wall (8) are preferably designed as presented in more detail in FIG. 3. Examples of suitable burners (2) for solid carbonaceous feeds are described in U.S. Pat. No. 4,887,962, U.S. Pat. No. 4,523,529 and U.S. Pat. No. 4,510,874. Possible burners for a liquid feed are the well known multi-annular burners as known for such feeds.

FIG. 1 also shows that between the wall (8) of the combustion chamber (6) and the wall of vessel (1) an annular space (9) is provided. The wall (8) of the combustion chamber (6) comprises of an arrangement of interconnected tubes (10). The tubular part of the wall (8) may be comprised of vertical arranged tubes (10) as shown in FIG. 1 or alternatively may be comprised of a helical coiled tube.

Preferably the tubes are vertically arranged in the tubular part of the wall (8). The cooling medium which flows in tubes (10) may be water which provides cooling to the wall by means of evaporation or sub-cooled water which does not evaporate in tubes (10).

The wall (8) of the combustion chamber (6) comprised of an arrangement of interconnected parallel arranged tubes (10) results in a substantially gas-tight wall. Such a wall is also referred to as a membrane wall. The tubes (10) run from a common lower arranged distributor (12) to a higher arranged common header (11). The distributor (12) is provided with a cooling water supply conduit (14). The header (11) is provided with a steam discharge conduit (13). The steam discharge conduit (13) and the water supply conduit (14) are fluidly connected to a steam drum (29). The steam drum (29) is provided with a supply conduit (32) for fresh water and an outlet conduit (30) for produced steam. As shown in the Figure, the steam drum (29) is positioned at a higher elevation than the common header (11). A preferred water pump (31) is shown to enhance the flow of water from steam drum (29) to the distributor (12).

Applicants found that by cooling the wall (8) with evaporating steam in the tubes (10) as shown in FIG. 1 a reactor is provided which retains its cooling capacity even in the event that no fresh cooling water is added to the steam drum (29) via (32). Because the steam drum (29) is located at a higher elevation than the common header (11), water as present in the steam drum (29) will flow due to gravity to the common distributor (12) of the gasification reactor. An additional advantage is that steam is produced which can be advantageously used for other applications in a process, which incorporates the gasification reactor. Such applications are process steam for optional downstream shift reactions, heating medium for an optional liquid carbonaceous feed or, after external superheating, as moderator gas in the burner. A more energy efficient process is so obtained making use of this reactor. Possible liquid feeds having a low ash content are for example the liquid residual fractions of a tar sands source. Another example is flash pyrolysis oil or slurries of flash pyrolysis oil and flash pyrolysis char as obtained from a biomass source. A possible biomass source may be wood or the residual fractions as obtained in the agricultural industry, such as for example straw and grassy materials. Examples are streams generated in the palm oil industry, corn industry, and bio-diesel industry.

Possible solid feeds are low ash coals and biomass. Preferred biomass derived solid feeds are pre-treated by means of torrefaction of above described biomass source. Torrefaction is advantageous because a solid feed is obtained which resembles coal particles and use can be made of known coal feed methods to said reactor. The reactor according to the invention may also be beneficial for all ash-content feeds such as all types of coal because of the high capacity of the reactor in combination with e.g. a water quench.

The tubes (10) are preferably coated with a refractory in order to protect said tubes against the attack from molten slag.

The product gas outlet (7) of the combustion chamber (6) fluidly connects the top part of vessel (1) with a lower part (23) of the gasification reactor. The lower part of the combustion chamber (6) is preferably sloped such to allow the layer of slag to flow to product gas outlet (7) which has a smaller diameter than the combustion chamber (6) itself. In FIG. 1 it is shown that this sloped part of the combustion chamber (6) is composed of an arrangement of interconnected tubes (24) through which, in use, a cooling medium flows as in tubes (10). The lower part (23) is provided with an outlet (26) for product gas. This lower part (23) is preferably provided with means to cool the product gas having the elevated temperature as it leaves the combustion chamber (6). Such cooling means may be by indirect cooling in a waste heat boiler as shown in earlier referred to U.S. Pat. No. 5,968,212. Alternatively, cooling may be achieved by injecting a cooling medium into the hot product gas as described in DE-A-19952754. More preferably, cooling is achieved by quenching in a water bath (20) in a water quenching zone (19). To enable quenching in said water bath (20) the outlet opening (7) of the combustion chamber (6) is preferably fluidly connected to a dip-tube (16). Dip-tube (16) is partly submerged in a water bath (20) located at the lower end of the reactor (1). Preferably, at the upper end of the dip-tube (16) injecting means (18) are present to add a quenching medium to the, in use, downwardly flowing hot product gas, i.e. the mixture of hydrogen and carbon monoxide. The dip-tube (16) is preferably vertically aligned with the combustion chamber (6) and tubular formed.

The water quenching zone (19) is present in the pathway of the hot product gas as it is deflected at outlet (17) in an upwardly direction (see arrows) to flow upward through, an annular space (21) formed between the wall of vessel (1) and dip-tube (16). In annular space (21), the hot product gas will intimately contact the water in a quenching operation mode. In annular space (21), a water level (25) will be present. Above said water level (25) one or more product gas outlet(s) (26) are located in the wall of reactor vessel (1) to discharge the quenched product gas. Between space (21) and annular space (9) a separation wall (27) may optionally be present. The product gas will consist for its majority of hydrogen and carbon monoxide. Such a gas is also referred to as synthesis gas.

At the lower end of the gasification reactor (1) a slag discharge opening (28) is suitably present. Through this discharge opening (28) slag together with part of the water is discharged from the vessel by well known slag discharge means, such as sluice systems as for example described in U.S. Pat. No. 4,852,997 and U.S. Pat. No. 6,755,9802.

The gasification reactor according to invention is preferably operated such that the hot product gas, as it is discharged from the outlet (7), has a temperature of between 1000 and 1800° C. and more preferably between 1300 and 1800° C. The pressure in the combustion chamber and thus of the product gas is preferably between 0.3 and 12 MPa and preferably between 2 and 8 MPa. The temperature conditions are so chosen that the slag will create a layer. The layer of slag will flow to a lower positioned slag outlet device in the reactor.

The quenching medium as provided via injecting means (18) is preferably water, synthesis gas or steam or a combination of both. The water may be fresh water. Optionally, the water may be the process condensate of an optional downstream water shift unit. In a preferred embodiment, a solids containing water may partly or wholly replace the fresh water. Preferably the solids containing water is obtained in the water quenching zone (19). Alternatively, the solids containing water may be the bleed stream of a optional downstream water scrubbing unit (not shown). The use of a solids containing water as here described has the advantage that water treatment steps may be avoided or at least be limited.

The temperature of the product gas after contacting the gas in the quench zone (19) as it is discharged from the reactor (1) at outlet (26) is preferably between 130 and 330° C.

Figure 1A:
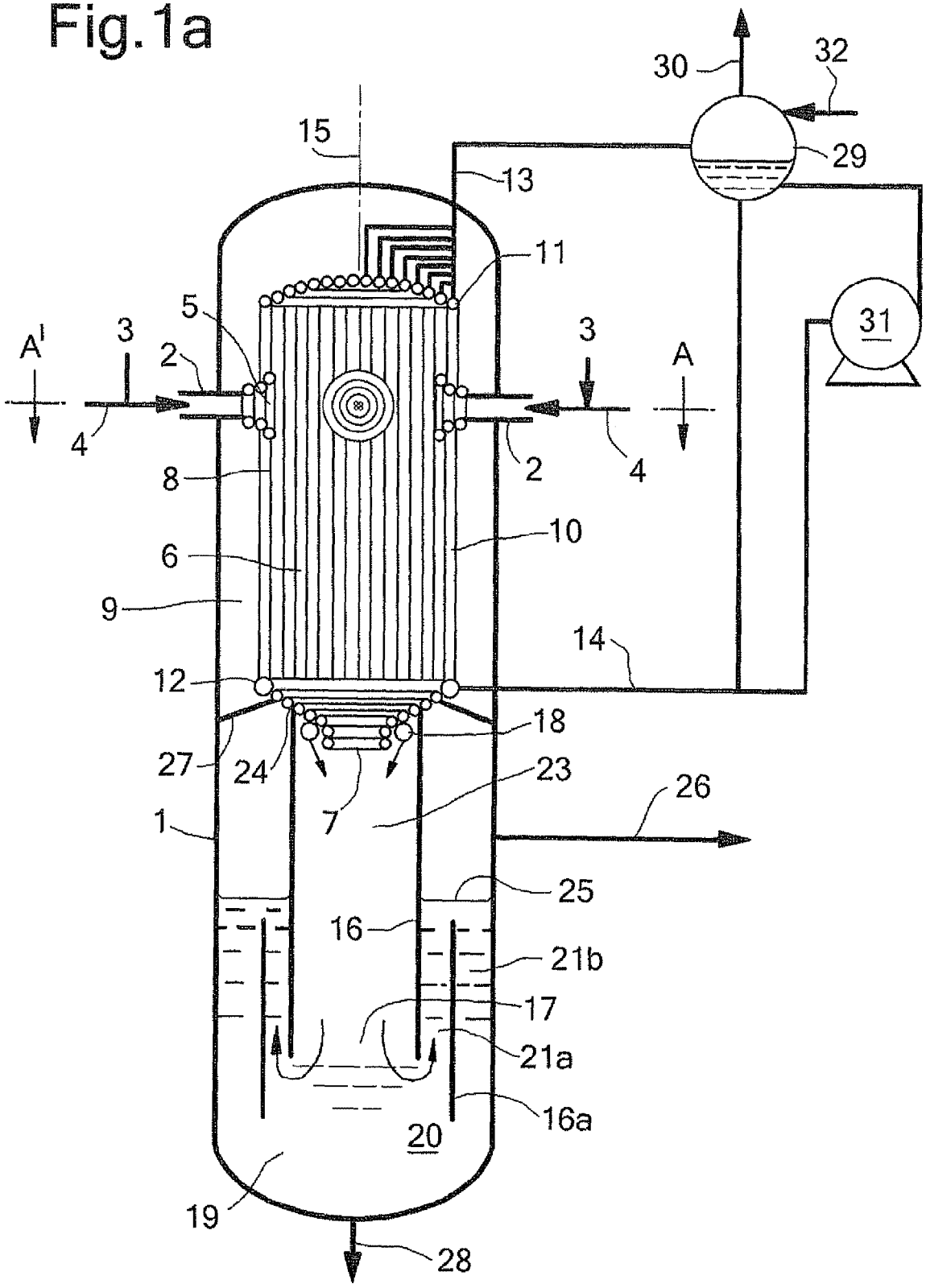
FIG. 1*a* is a schematic presentation of the reactor according to the present invention and shows the reactor of FIG. 1 with a draft tube.

FIG. 1*a*, shows the reactor of FIG. 1 wherein a draft tube (16*a*) is added. Draft tube (16*a*) envelopes the dip-tube (16) and preferably extends, in use, downwardly within the water quenching zone (19) to a level below that at which the lower extremity of the dip-tube (16) terminates. The hot product gas is deflected at outlet (17) in an upwardly direction (see arrows) to flow upward through, the annular space (21*a*) formed between the draft tube (16*a*) and dip-tube (16). By having a draft tube (16*a*) a better defined circulation of water is achieved wherein water flows upwards via annular space (21*a*) and downwards via annular space (21*b*) as present between vessel wall and draft tube (16*a*). This is advantageous for cooling both the hot gas and the wall of the dip-tube (16). Such a draft tube is for example described in U.S. Pat. No. 4,605,423.

Figure 2:
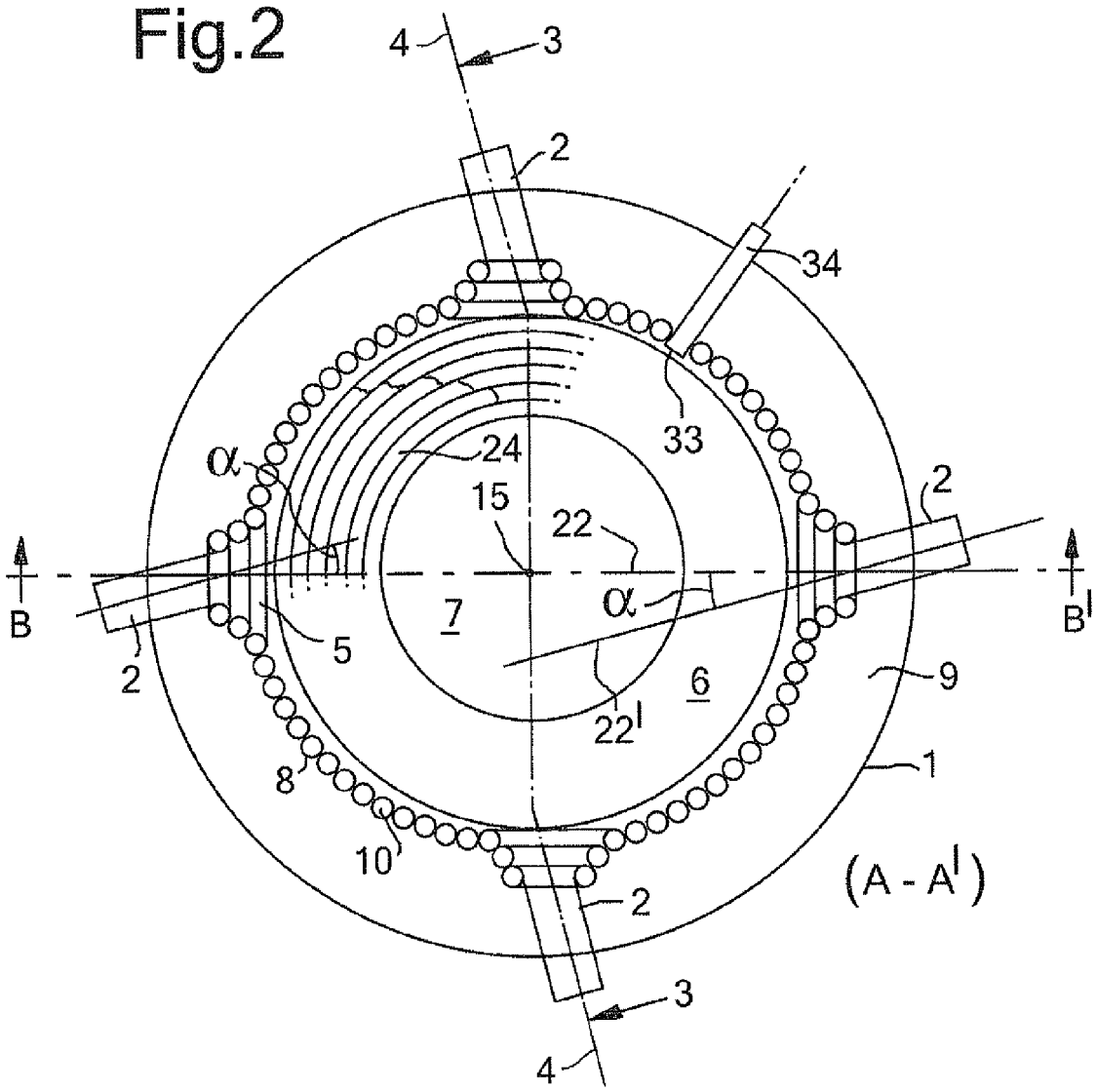
FIG. 2 is a cross-sectional view AA' of the reactor according to FIG. 1.

FIG. 2 is a cross-sectional view AA' of the reactor of FIG. 1. The corresponding reference numbers of FIG. 2 have the same meaning as in FIG. 1. Only part of the tubes (24) are shown for clarity reasons. Preferably the firing angle ($\alpha$) of the burners relative to the horizontal line (22) connecting the burner opening (5) and the vessel axis (15) is between 1° and 8°. The direction of firing line (22') of the burner is the longitudinal axis of the burner itself. It has been found that such a so-called tangential firing further enhances the flow of the product gas in a spirally motion and thus further forces the slag to the wall.

FIG. 2 also shows a preferred opening (33) in the wall (8) for a start-up burner (34).

Figure 3:
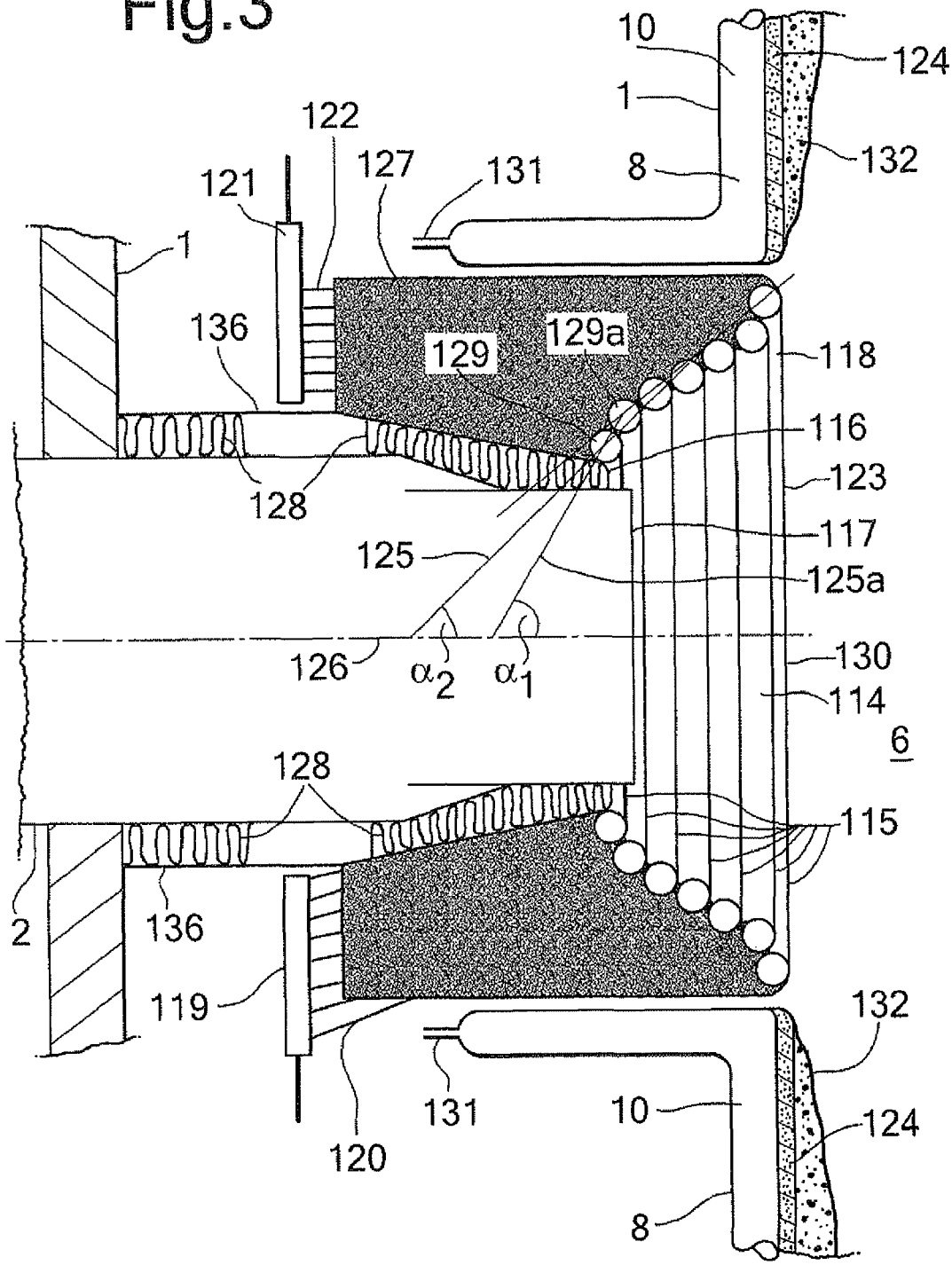
FIG. 3 is a detailed presentation of a burner muffle.

FIG. 3 shows a so-called burner muffle (114), which is a preferred burner opening in the wall (8). The corresponding reference numbers of FIG. 3 have the same meaning as in FIG. 1. Applicants have found that by providing adequate cooling to the surfaces of the burner muffle (114) as shown in FIG. 3 a robust design is obtained having a prolonged lifetime and which can operate at different gasification conditions. The burner muffle (114) comprises several vertically oriented, concentric and interconnected rings (115). Preferably at least 1 or more and more preferably all rings (115) are conduits having individual inlets for a cooling medium via lines (120) and individual outlets for used cooling medium via lines (122). The thickness of the wall of the conduits is preferably as small as possible to allow for a good heat transfer and to limit the wall temperature. The minimum wall thickness will be determined by the mechanical strength as locally required. A skilled person can easily determine the correct dimensions for such a conduit. The diameter of the conduit is preferably between 0.02 and 0.08 m. The rings are preferably made from a low alloy steel with a Cr content up to 5 wt % or a high alloy steel with Cr content above 15 wt %.

Lines (120) and lines (122) are fluidly connected to cooling medium, typically water, distributor (119) and a common, typically water-/steam mixture, header (121) respectively. The cooling water as supplied via lines (120) may be from the same source as the cooling water supplied to the tubes (10) of wall (8). It can be also from a different source, which may have a lower water temperature and/or a different pressure. The rings are preferably welded together.

Rings (115) have an increasing diameter relative to its neighbouring ring (115) resulting in that the burner muffle (114) has a muffle opening (116) for the burner head (117) at one end and a larger opening (118) at its other—flame discharge—end (123). Opening (118) is the same as opening (5) of FIGS. 1 and 2. The muffle opening (116) is horizontally spaced away from the larger opening (118). This results in that the connected rings have a cone-shaped form.

Preferably, the angle $\alpha$1 between the horizon (126) and the direct line (125*a*) between the inner positioned ring (129) at the muffle opening (116) for the burner head (117) and the next ring (129*a*), adjacent to the inner ring (129), is between 15 and 60°. Preferably, the angle $\alpha$2 between the horizon (126) and the direct line (125) between the inner positioned ring (129) at the muffle opening (116) for the burner head (117) and the outer positioned ring (130) at the opening (118) at the flame discharge end (123) is between 20 and 70°. The line (125) is drawn from the centre of ring (129) to the centre of ring (130) as shown in FIG. 3. Preferably, $\alpha$1 is greater than $\alpha$2. The outer positioned ring (130) is the ring that forms the muffle opening (116) for the burner head (117).

Preferably, the number of rings (115) is between 6 and 10. The rings (115) may form a S-curve along line (125) as shown. Preferably, a sealing (128) is present between the shaft of burner (113) and the burner sleeve (136). The sealing (128) can be extended to the burner head (117) as shown. Such a sealing (128) avoids gas and any fly-ash and/or slag as present in the reaction zone to enter the burner sleeve (136) as present in the space between the wall of vessel (1) and wall (8). By avoiding such a gas flow, local heat fluxes are further reduced. The sealing (128) is preferably a flexible sealing that can accommodate local thermal expansions. Examples of suitable sealing materials are fibre woven and or knitted wire mesh type sealing.

FIG. 3 also shows part of the wall (8) and tubes (10). The wall (8) comprises several vertical and interconnected tubes (10).

Tubes (10) are provided with supply and discharge lines (131) as schematically shown. The tubes (10) are coated with refractory (124). In use the refractory (124) in turn will be covered by a layer of slag (132).

FIG. 3 also shows a refractory mass (127) installed around the burner muffle (114), which prevent slag from entering the backside of the muffle (114) with a possible shortcut to the burner head (117).

The burner muffle (114) of FIG. 3 may also be designed such that it protrudes into the combustion chamber (6). Applicants have found that such a protrusion may be beneficial to avoid slag (132) from entering the burner muffle (114). Preferably, at least one ring (115) of the burner muffle (114) protrudes into the combustion chamber (6).

That which is claimed is:

1. A gasification reactor vessel, comprising a combustion chamber in the upper half of the vessel, when in use, provided with a product gas outlet at the bottom end of the combustion chamber, a burner positioned such that, in use, it fires into the combustion chamber, said burner provided with at least supply conduits for an oxidizer gas and a carbonaceous feed, wherein between the wall of the combustion chamber and the wall of vessel an annular space is provided, and wherein the wall of the combustion chamber comprises an arrangement of interconnected tubes, and wherein two burner openings are present in the wall of the combustion chamber, which burner openings are located at the same horizontal level and are positioned diametrical relative to each other and wherein in the burner openings a burner is present wherein the product gas outlet at the bottom end of the combustion chamber is fluidly connected to a dip-tube, which partly is submerged in a water bath located at the lower end of the reactor vessel; and wherein at the upper end of the dip-tube means are present to add a quenching medium to the, in use, downwardly flowing mixture of hydrogen and carbon monoxide.

2. The reactor according to claim 1, wherein the firing angle of the burners relative to the horizontal line connecting the burner opening and the vessel axis is between 1° and 8°.

3. The reactor according to claim 1, wherein in addition to the burner openings an opening is present for a start-up burner, said opening being provided in the wall of the combustion chamber, and wherein the start-up burner is positioned in said opening, and wherein a cooling medium flows in the tubes of the wall of the combustion chamber.

4. The reactor according to claim 1, wherein the wall of the combustion chamber is coated with refractory.

5. The reactor according to claim 1, wherein at the lower end of the reactor vessel a slag discharge opening is present to discharge slag from the reactor vessel.

6. The reactor according to claim 1, wherein the burner opening is a burner muffle comprising several vertically oriented, concentric and interconnected rings, wherein the rings have an increasing diameter relative to its neighboring ring resulting in that the burner muffle has a muffle opening for the burner at one end and a larger opening at its other—flame discharge—end, the rings being a conduit having an inlet end for a cooling medium and an outlet for used cooling medium and wherein the muffle opening for the burner is located between the wall of the vessel and the wall of the combustion chamber.

* * * * *